US007938110B2

(12) United States Patent
Udwin

(10) Patent No.: US 7,938,110 B2
(45) Date of Patent: May 10, 2011

(54) BALL LAUNCHING DEVICE

(75) Inventor: Steven Udwin, Tenafly, NJ (US)

(73) Assignee: Enor Corporation, Northvale, NJ (US)

( * ) Notice: Subject to any disclaimer, the term of this patent is extended or adjusted under 35 U.S.C. 154(b) by 45 days.

(21) Appl. No.: 12/508,165

(22) Filed: Jul. 23, 2009

(65) Prior Publication Data

US 2011/0017185 A1 Jan. 27, 2011

(51) Int. Cl.
*F41B 11/00* (2006.01)

(52) U.S. Cl. ..... 124/65

(58) Field of Classification Search ..... 124/65
See application file for complete search history.

(56) References Cited

U.S. PATENT DOCUMENTS 1,660,127 A * 2/1928 Jonassen ..... 124/27
2,505,428 A * 4/1950 Pope ..... 124/65
2,601,555 A * 6/1952 Pope ..... 124/65
2,630,108 A * 3/1953 White ..... 124/65
2,653,593 A * 9/1953 Foster ..... 124/65
2,725,868 A * 12/1955 Foster ..... 124/65
2,749,902 A * 6/1956 Foster ..... 124/65
2,762,356 A * 9/1956 Foster ..... 124/65
2,762,357 A * 9/1956 Foster ..... 124/65
3,236,521 A * 2/1966 Knott ..... 473/457
3,765,396 A * 10/1973 Kienholz et al. ..... 124/65
5,113,842 A * 5/1992 Moormann ..... 124/65
5,115,794 A 5/1992 Moormann
5,377,656 A * 1/1995 Lewinski et al. ..... 124/65

* cited by examiner

*Primary Examiner* — Troy Chambers
(74) *Attorney, Agent, or Firm* — Ladas & Parry LLP

(57) ABSTRACT

A ball launcher of the type that includes a piston slidable in a launch tube to increase air pressure behind a ball loaded into a front end of the launcher includes a launch tube of an outwardly flared construction to a diameter greater than the diameter of the ball loaded into the launcher. The outwardly flared end has an inwardly directed peripheral ledge defining an aperture smaller than the ball diameter. A spring located within the flared end biases the loaded ball against the ledge to create and maintain a pneumatic seal between the ball and ledge prior to launch.

5 Claims, 3 Drawing Sheets

BALL LAUNCHING DEVICE

The present invention relates to a toy, and in particular to an air-driven toy ball gun or launcher.

BACKGROUND OF THE INVENTION

Devices to launch or shoot soft balls are known in the toy art. U.S. Pat. No. 5,115,794 to Moorman discloses a compressible ball launcher that uses compressed air to launch a ball from the end of a tube. The ball is held loosely at the end of the tube. A plunger in the tube is depressed by the user, compressing the air in the tube. The compressed air drives the ball from the tube, accompanied by a loud popping sound, improving the play experience.

The construction disclosed in the '794 patent utilizes a soft compressible closed cell foam ball that is loaded into the front of the shooting tube and is retained between two neck-like constrictions. The plunger is then retracted, drawing air into the shooting tube as the ball is also drawn rearwardly to rest against the rear neck. The plunger is then forced quickly back into the tube, compressing the air within the tube. This moves the ball forward towards the forward neck. The compressibility of the ball seals the ball against the neck as pressure inside the tube is increased as the plunger continues is travel within the tube, until the increasing pressure against the ball is sufficient to compress and distort the ball so that it can pass the neck constriction and shoot from the tube. The rapid passage of the ball past the neck constriction is accompanied by a loud "popping" sound, as the compressed air is vented from the front of the tube.

The above construction relies solely upon the compressibility of the foam to form and maintain an air-tight seal with the forward neck constriction as pressure is built up in the tube. Since the ball must first lodge against the front neck by the increasing tube pressure, some air leaks from the front of the tube as the piston is depressed and before the ball sufficiently seats against the front neck to form the needed airtight seal.

It is accordingly a purpose of the present invention to provide an improved ball launcher device that utilizes compressed air that allows an effective seal to be maintained at all times between the ball to be launched and the tube launcher.

A further purpose of the present invention is to provide a ball launcher of the aforementioned type that uses solid, rather than foam, balls.

Yet a further purpose of the present invention is to provide a ball launcher in which the ball is held securely in place during the pressurization of the tube to avoid air loss.

BRIEF SUMMARY OF THE INVENTION

In accordance with the forgoing and other objects, a ball launcher of the present invention includes a launch tube with a generally conical launch tube front end. The front end is provided with an annular ledge defining an opening slightly smaller that the diameter of a ball to be launched. A ball to be launched is retained within the conical section, and is biased against the ledge, sealing the ball against the ledge. A plunger is arranged for travel within the tube. When the plunger is driven inwardly within the tube pressure in the tube increases to the point where the force of the ball against the ledge causes the ball to compress and distort slightly at the point of contact, allowing the ball to explosively pass through the ledge opening, accompanied by a popping sound.

BRIEF DESCRIPTION OF THE DRAWINGS

A fuller understanding of the invention will be appreciated upon consideration of the following detailed description of a preferred but nonetheless illustrative embodiment thereof, when reviewed in association with the annexed drawings, wherein.

DETAILED DESCRIPTION OF THE INVENTION

Figure 1:
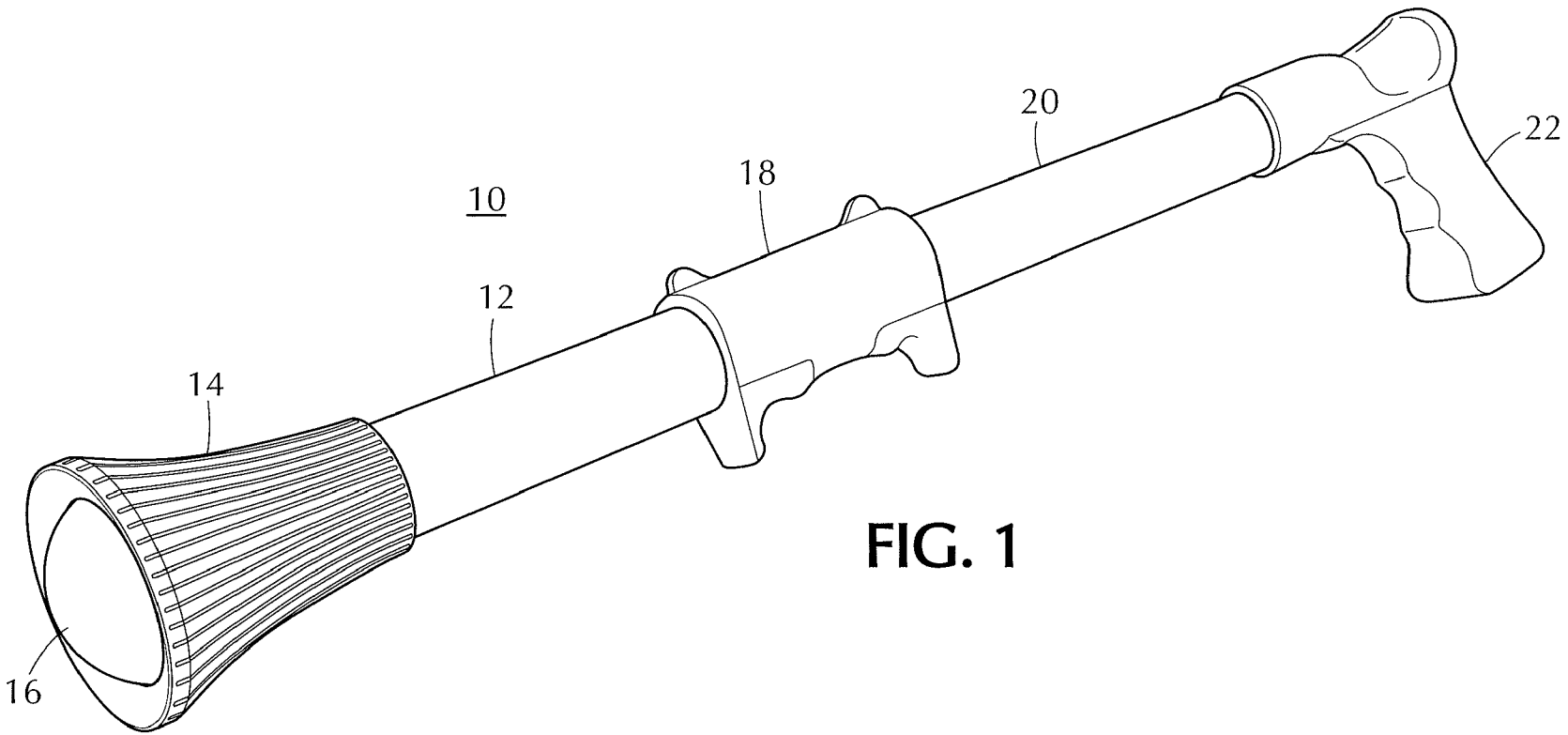
FIG. 1 is a perspective view of a ball launcher of the invention.
Figure 2:
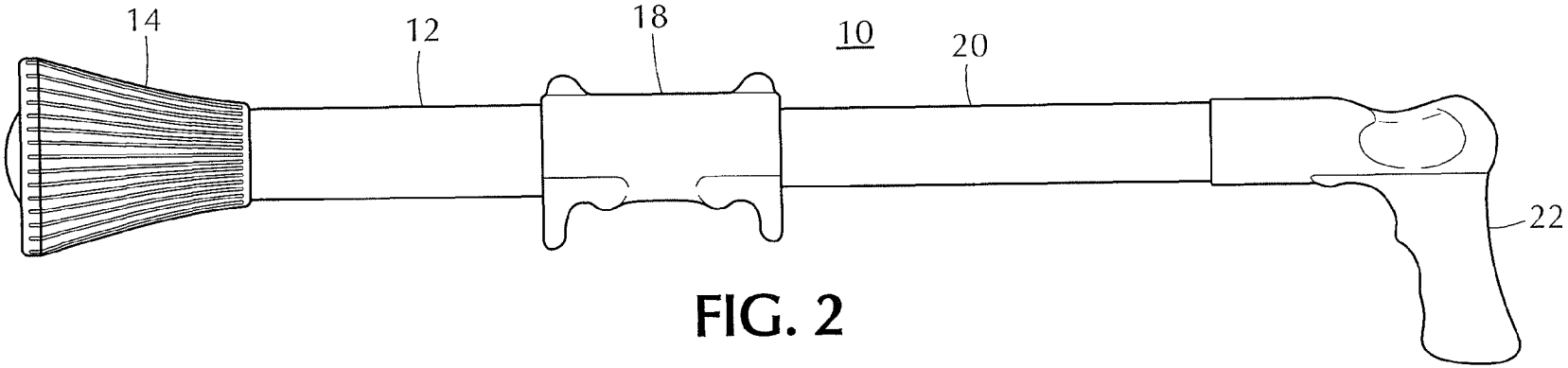
FIG. 2 is a side view thereof.

With consideration of FIGS. 1 and 2, ball launcher 10 of the invention includes launch tube 12 with an outwardly flared front portion 14 into which a ball 16 is loaded. On overlying handgrip 18 may be positioned at the rear end of the launch tube. Piston 20 fits within the launch tube, and extends rearwardly beyond the rear open end of the launch tube. A second, pistol hand grip 22 may be affixed to the piston's rear end. With the user holding both hand grips, the piston 20 can be extended back and outwardly from the launch tube 12 to "cock" the launcher and then rapidly pushed forwardly into the launch tube to compress the air therein and launch the ball 16.

Figure 3:
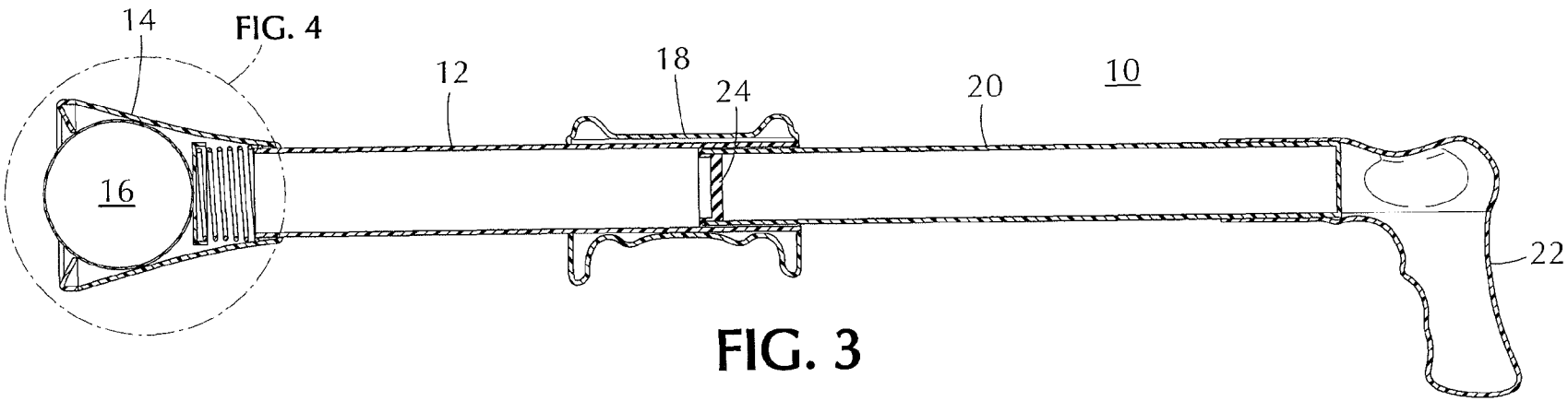
FIG. 3 is a side cross-sectional view thereof.
Figure 4:
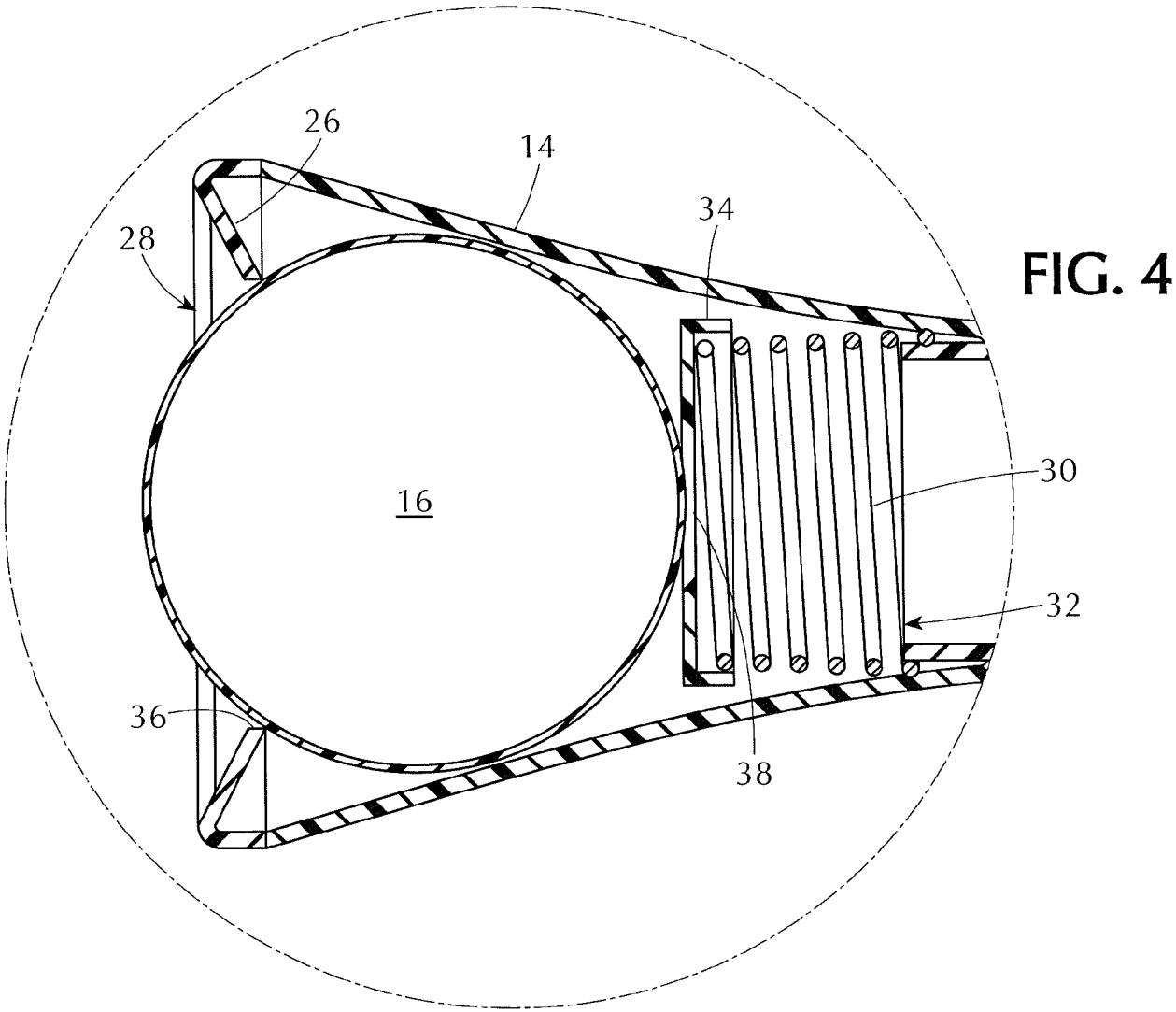
FIG. 4 is a detail cross-sectional view of the front portion of the launch tube.

With further reference to FIGS. 3 and 4, piston 20 is provided with a sealing ring 24 at its forward end to create a pneumatic seal with the launch tube 12 as the piston is moves forward for ball launching. As known in the art, the sealing ring may be constructed to allow air to pass by the ring into the forward portion of the tube (to the left of the sealing ring in the figures) as the piston is extended back out of the tube (to the right in the figures).

The outwardly flared forward end 14 of the launch tube is dimensioned to substantially accept a ball 16 therein. As shown, the forward end may be formed as a piece separate from the main portion of the launch tube, mounted to the front of the main portion by a friction fit and sealed thereto for example by welding or and adhesive to make an air-tight seal therebetween. The diameter of the main portion of launch tube 12 is less than the diameter of a ball, whereby the ball is maintained within the flared portion upon insertion. The flared portion includes an inner peripheral annular ledge 26 at its distal end, defining an opening or entryway 28 of a diameter slightly smaller than that of the ball 16. The diameter difference may be on the order of 1 to 2 mm. Preferably, the ledge 26 is angled inwardly to the flared end, facilitating ball insertion, and is provided with a well-defined corner 36 to engage the ball surface.

Spring 30 is positioned within the flared section 14, and may be supported at its rear end by the forward end 32 of the main portion of launch tube 12. The spring may have an annular cap 34 at its forward end, the cap's central opening 38 dimensioned to accept a small portion of the loaded ball 16. The length of the spring is such that, with the ball loaded into the flared portion from the front of the launcher, it biases the ball forwardly against the peripheral ledge 26, sealing the ball against the ledge in an airtight manner, irrespective of the orientation of the launch tube and whether or not the launch tube is pressurized. The inward cant to the ledge provides a well-defined line of contact between the corner 36 and the surface of the ball, providing a secure seal. The ball 16 is preferably of a hollow construction, formed of thin wall LDPE with an internal pressure on the order of 20 to 30 psi. While the ball is generally rigid, it can be compressed and distorted with moderate applied pressure, thus allowing the ball to be loaded into the launch tube by the user pressing and forcing the ball through the entryway into the flared section.

With the ball loaded into the launcher, the user may draw piston 20 rearwardly with respect to the launch tube. As discussed, the piston sealing ring 24 may be designed to allow air to pass by the seal into the tube. Alternatively, the drawing back of the piston may create a low pressure in the tube, allowing the ball to deform slightly and/or be drawn slightly further into the flared portion, over the biasing force of the spring, allowing air to enter into the tube through the entranceway 28 and past the contacting ball edge.

With the piston fully withdrawn the piston is then rapidly driven forward, compressing the air in the launch tube, the front end of the tube being sealed by the ball biased by spring 30 against sealing flap 24. When the pressure in the tube is sufficiently high, the ball compresses and distorts slightly, allowing the ball to pass outwardly through the entranceway 28, accompanied by a loud "popping" sound as the compressed air is likewise released.

The launcher may be constructed of an appropriate material, such as a plastic composition, with the handles joined to the launch tube by an adhesive. The spring can likewise be of a plastic construction.

I claim:

1. In a ball launcher of the type that includes a piston slidable in a launch tube to increase air pressure behind a ball loaded into a front end of the launcher, the improvement comprising the front end for the launch tube being flared outwardly from a diameter of the tube to a diameter greater than a diameter of the ball loaded into the launcher, the outwardly flared end having an inwardly directed peripheral ledge defining an aperture smaller than the ball diameter, a spring for biasing the loaded ball within the flared end against the ledge to create and maintain a pneumatic seal between the ball and ledge prior to launch, and a cap located at a forward end of the spring to contact the loaded ball.

2. The improvement of claim 1 wherein the loaded ball is of a hollow construction, constructed of LDP, and with an internal pressure of between 20 and 30 psi.

3. The improvement of claim 1 wherein the ledge has a continuous corner arranged for sealing contact with the loaded ball.

4. In a ball launcher of the type that includes a piston slidable in a launch tube to increase air pressure behind a ball loaded into a front end of the launcher, the improvement comprising the front end for the launch tube being flared outwardly from a diameter of the tube to a diameter greater than a diameter of the ball loaded into the launcher, the outwardly flared end defining an aperture smaller than the ball diameter, and means for biasing the loaded ball within the flared end against the ledge to create and maintain a pneumatic seal between the loaded ball and ledge prior to launch, the loaded ball being of a hollow construction, constructed of LDP, and with an internal pressure of between 20 and 30 psi.

5. The improvement of claim 4, wherein the ledge has a continuous corner arranged for sealing contact with the loaded ball.

* * * * *